US007540327B2

(12) United States Patent
Billingham

(10) Patent No.: US 7,540,327 B2
(45) Date of Patent: Jun. 2, 2009

(54) ABRASIVE JET CUTTING SYSTEM AND METHOD FOR CUTTING WELLBORE TUBULARS

(75) Inventor: Matthew Billingham, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 230 days.

(21) Appl. No.: 11/420,170

(22) Filed: May 24, 2006

(65) Prior Publication Data

US 2007/0251692 A1 Nov. 1, 2007

Related U.S. Application Data

(63) Continuation-in-part of application No. 11/380,690, filed on Apr. 28, 2006.

(51) Int. Cl.
*E21B 29/06* (2006.01)
*E21B 29/00* (2006.01)

(52) U.S. Cl. ..... 166/298; 166/55.7; 166/223

(58) Field of Classification Search ..... 166/298, 166/55.6–55.8, 169, 223
See application file for complete search history.

(56) References Cited

U.S. PATENT DOCUMENTS 2,884,761 A * 5/1959 Miles et al. ..... 405/53
5,033,549 A 7/1991 Champeaux
5,115,860 A 5/1992 Champeaux
5,224,547 A 7/1993 Burns
5,228,507 A 7/1993 Obrejanu
5,310,001 A 5/1994 Burns
5,322,118 A 6/1994 Terrell
5,381,631 A * 1/1995 Raghavan et al. ..... 451/75
5,398,753 A 3/1995 Obrejanu
5,445,220 A * 8/1995 Gurevich et al. ..... 166/55
5,575,331 A 11/1996 Terrell
5,592,991 A 1/1997 Lembcke
5,636,689 A 6/1997 Rubbo
5,778,980 A 7/1998 Comeau
5,879,057 A * 3/1999 Schwoebel et al. ..... 299/17
6,029,744 A 2/2000 Baird
6,196,309 B1 3/2001 Estilette
6,868,901 B2 3/2005 Mason
7,140,429 B2 * 11/2006 Grebennikov et al. ..... 166/55
2004/0134687 A1 * 7/2004 Radford et al. ..... 175/57

* cited by examiner

*Primary Examiner*—Shane Bomar
(74) *Attorney, Agent, or Firm*—Rodney Warfford; David Cate; Jaime Castano

(57) ABSTRACT

An embodiment of a cutting tool positionable in a tubular for creating a cut in a tubular includes a body securable within the tubular and a cutting head having a nozzle for discharging a pressurized cutting fluid, wherein the cutting head is rotationally and axially moveable relative to the body. The cutting tool may further include one or more of a positioning mechanism, a linear actuator in connection with the cutting head, a rotary actuator in connection with the cutting head, a cutting fluid pump, a mechanism for mixing a fluid and an abrasive to form the abrasive cutting fluid, and reservoirs for storing the abrasive cutting fluid or for storing a fluid and the abrasive separately.

22 Claims, 2 Drawing Sheets

ABRASIVE JET CUTTING SYSTEM AND METHOD FOR CUTTING WELLBORE TUBULARS

This application is a Continuation-in-Part of U.S. patent application Ser. No. 11/380,690, filed Apr. 28, 2006.

FIELD OF THE INVENTION

The present invention relates in general to wellbore operations and more particularly to systems and methods for cutting tubulars in a wellbore.

BACKGROUND

At various stages in a well's life it may be necessary to cut the tubulars used in its construction. This may be required during completion of the well, operation of the well or upon abandonment of the well. Reasons for cutting the pipe include without limitation, cutting a tubular that is stuck in the wellbore, cutting a window for side tracking the present wellbore and cutting fluid pathways.

Prior art methods for making radial cuts include explosive jet cutters, chemical cutters and mechanically cutting with drill pipe or coiled tubing. Each of this mechanisms and methods have drawbacks. For example, with regard to explosive cutters, it is difficult to create clean cuts and to not damage material behind the cut. Additionally, health and safety concerns dictate strict operational procedures be employed when utilizing explosive cutters. With regard to chemical cutting tools, the cut depth is limited by the nature of the system and the completion. With regard to mechanical cutting, when performed using drill pipe or coiled tubing the use of a rig is required; thus increasing time loss and expenses.

Therefore, it is a desire to provide a cutting tool and method for creating various types of cuts in a tubular that address drawbacks of the prior art systems and methods. It is a further desire to provide a cutting tool and method for making radial cuts as well as window cuts in a tubular. It is a still further desire to provide a cutting tool and method for creating various cuts in a tubular via a wireline.

SUMMARY OF THE INVENTION

Accordingly, a cutting tool and method for creating a continuous cut in a tubular that is positioned in a wellbore is provided.

An embodiment of a cutting tool, positionable in a tubular for creating a cut in a tubular, includes a body securable within the tubular and a cutting head having a nozzle for discharging a pressurized cutting fluid, wherein the cutting head is rotationally and axially moveable relative to the body. The cutting tool may further include one or more of a positioning mechanism, a linear actuator in connection with the cutting head, a rotary actuator in connection with the cutting head, a cutting fluid pump, a mechanism for mixing a fluid and an abrasive to form the abrasive cutting fluid, and reservoirs for storing the abrasive cutting fluid or for storing a fluid and the abrasive separately.

An embodiment of a method of creating a continuous cut through a tubular that is disposed in a wellbore includes the step of positioning a tool in the tubular, the tool having a nozzle for discharging a pressurized cutting fluid that penetrates and cuts the tubular, discharging the cutting fluid creating an initiation point of a cut through the tubular, extending the cut from the initiation point along a first path, and completing the cut.

A further embodiment of a method of creating a continuous cut through a tubular that is disposed in a wellbore includes the step of providing a cutting tool including a positioning mechanism, an anchoring mechanism, a linear actuator, a rotary actuator, a cutting fluid pump and a cutting head having a nozzle for discharging a pressurized cutting fluid that penetrates and cuts the tubular; positioning the tool in the tubular; securing the tool in the tubular; discharging the cutting fluid creating an initiation point of a cut through the tubular; extending the cut from the initiation point along a first path via at least one of the actuators; and completing the cut.

An embodiment of completing the continues cut includes continuing the cut past the initiation point along the first path to a termination point and then traversing the cut across the first path.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
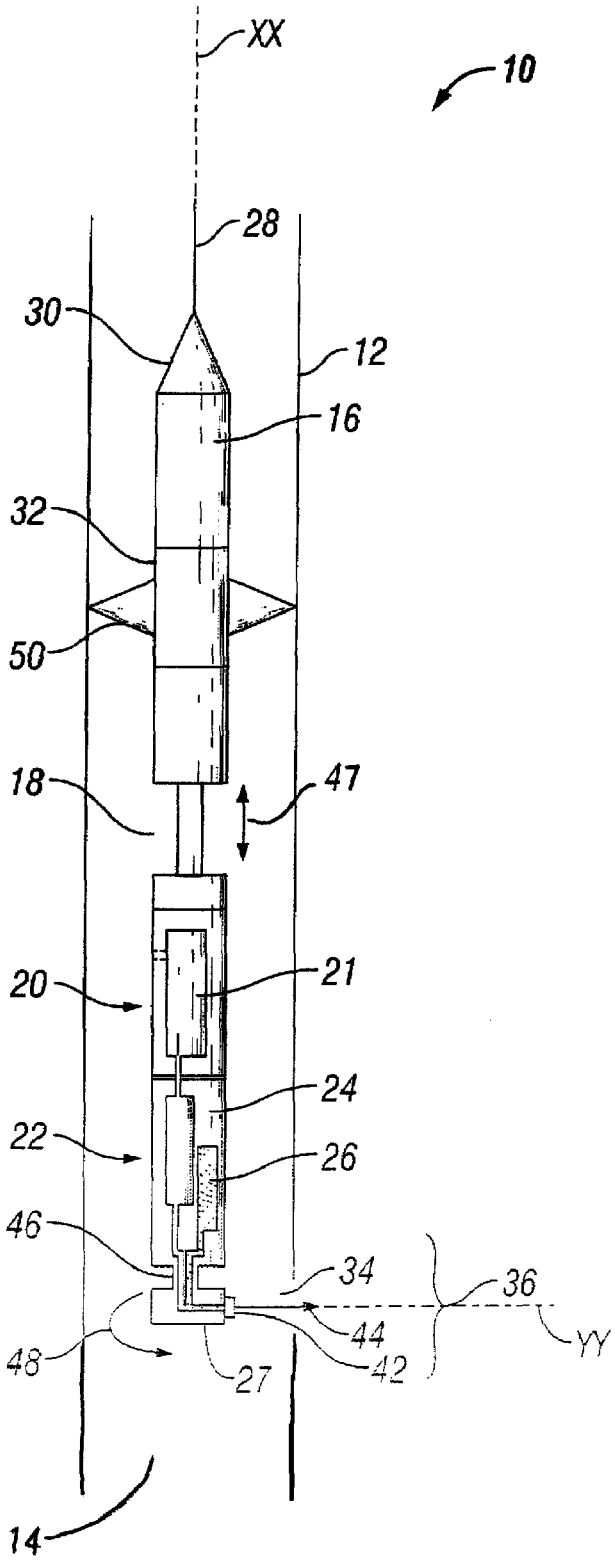
FIG. 1 is a schematic of an embodiment of an abrasive jet cutting tool of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point with the surface from which drilling operations are initiated being the top point and the total depth of the well being the lowest point.

FIG. 1 is a schematic drawing of an embodiment of an abrasive jet cutting tool of the present invention, generally denoted by the numeral 10. The cutting tool 10 is positioned within a tubular 12 disposed in a wellbore 14 to create a cut 34 in the tubular 12. As will be described in detail herein, the method and system of the present invention can provide linear and non-linear cuts in a tubular 12.

The cutting tool 10 of the present embodiment includes a positioning module 16, a linear actuator 18, a fluid pump 20, and a cutting unit 22. The fluid pump 20 further comprises a fluid chamber 21. In some embodiments, the fluid chamber 21 further comprises a filter. In such embodiments, well fluids are drawn into the fluid chamber 21 and filtered for contaminants until suitable for use in the cutting unit 22. In alternate embodiments of the fluid chamber 21, where the existing well fluids are not suitable for use in the cutting unit 22, the fluid chamber 21 comprises one or more fluid carriers to allow for the cutting fluid to be carried to the cutting depth from surface.

The cutting unit 22 of the cutting tool 10 further comprises a high pressure pumping system 24, an abrasive fluid feeder 26, and a rotary cutting head 27. The rotary cutting head 27 comprises a nozzle 42 for discharging the cutting fluid. Movement of the cutting head 27 is provided by a linear actuator 18 and a rotary actuator 46 functionally connected to the cutting head 27.

The cutting tool 10 is connected to a conveyance means 28 via a head 30. In the embodiment illustrated, the conveyance means 28 is shown as a wireline; however, other conveyance means including, without limitation, coiled tubing may be utilized. The tool 10 may further include an anchor 32 for securing the tool 10 within a tubular 12.

During completion or operation of the well, it may be desired or necessary to cut a tubular 12 in a region 36. For example, it may be desired to remove a portion of a tubular 12 when it has become stuck in the wellbore 12 during completion or for plugging and abandonment operations. When a portion of a tubular 12 is to be removed, the tool 10 may be used to create a continuous, linear cut 34*a* (FIG. 2) radially through the tubular 12. In another example, it may be desired to create an opening or window 38 (FIG. 3A) in a tubular 12 to kick-off from the wellbore 14 or to provide a port for fluid ingress or egress. The window 38, of any geometric shape, may be formed by making a continuous non-linear cut (34*b*) with the tool 10.

To make a cut 34 in a tubular 12, the tool 10 is run into the wellbore 14 and the tubular 12 via a conveyance means 28 and positioned proximate the region 36 of interest. The cutting tool 10, and more specifically the cutting head 27, may be positioned utilizing the positioning module 16. The positioning module 16 may include various electronics, including without limitation, telemetry equipment and a casing collar locator. Upon positioning the tool 10 in the desired location, the anchor 32 may be actuated to secure the tool 10 within and to the tubular 12. It is desirable to secure the cutting tool 10 so that the tool 10 resists movement in response to the cutting operations facilitating a more accurate and continuous cut.

The linear actuator 18 provides movement of the cutting head 27 and the nozzle 42 axially, as shown by the arrow 47 relative to the tool 10 and the tubular 12. The axis "XX" represents both the longitudinal axis of the tool 10 and of the tubular 12 proximate the region 36 of interest. The rotary actuator 46 facilitates rotary motion of the cutting head 27, as indicated by the arrow 48, about the longitudinal axis "XX." Plane "YY" extends substantially perpendicular to axis "XX."

As discussed above, in some embodiments of the present invention, a fluid may be stored and carried within the fluid chamber 21 and then mixed with an abrasive from the feeder 26 to form the abrasive cutting fluid 44. The cutting fluid 44 is discharged through the nozzle 42 via the high pressure pumping system 24 for cutting the tubular 12. In alternate embodiments, the abrasive cutting fluid 44 may be pre-mixed and carried by the tool 10. The operation of the fluid pump 20, cutting unit 22 and actuators 18, 46 may be controlled via signals communicated by telemetry or through the conveyance means 28 to the positioning module 16. The positioning module, 16 including control electronics, is in functional connection with the cutting unit 22.

Figure 2:
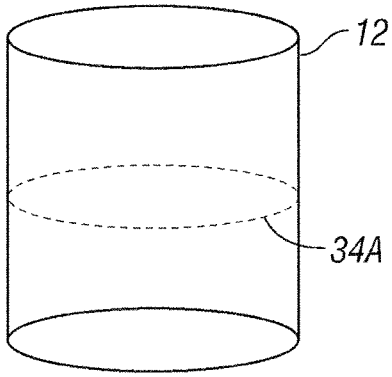
FIG. 2 is an illustration of a linear-radial cut created in a tubular utilizing an abrasive jet cutting tool of the present invention.

FIG. 2 is an illustration of a radial cut 34*a* created in a tubular 12 utilizing the cutting tool 10. With reference to FIG. 1, a method of creating a linear, radial cut 34*a* is described. The cutting tool 10 is positioned within the tubular 12 with the cutting head 27 positioned within the region 36 of interest. The anchor 32 is actuated to extend its arms 50 to engage the tubular 12 and stabilize the tool 10. The cutting unit 22 is energized, mixing the abrasive and fluid as cutting fluid 44 which is discharged via the pumping system 24 to initiate a cut 34*a*. The linear actuator 18 is maintained in the static position and the rotary actuator 46 is actuated to rotate the cutting head 27 to create a linear radial cut 34*a*. As is readily recognized, a linear, axial cut (along the axis "XX") may also be made by maintaining the rotary actuator 18 in the static position and activating the linear actuator 32 to move the cutting head 27 axially. A method for completing cut 34*a* is illustrated in FIG. 3B.

Figure 3A:
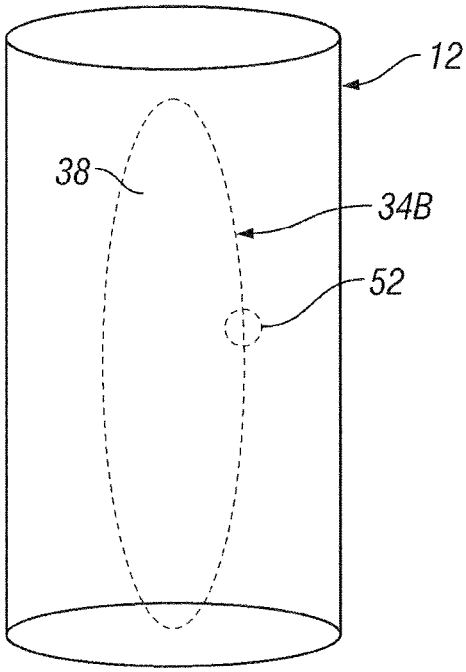
FIG. 3A is a an illustration of a non-linear cut utilizing an abrasive jet cutting tool of the present invention to create a window in a tubular.

FIG. 3A is an illustration of a non-linear cut 34*b* created in a tubular 12 utilizing the cutting tool 10 of FIG. 1 to form a window 38. The window 38 may be formed in any geometric shape by forming a continuous, non-linear cut 34*b*. A non-linear cut is made by utilizing the linear and the rotary actuators 18, 46 in combination to move the cutting head 27 along the desired path for the cut 34*b*.

Figure 3B:
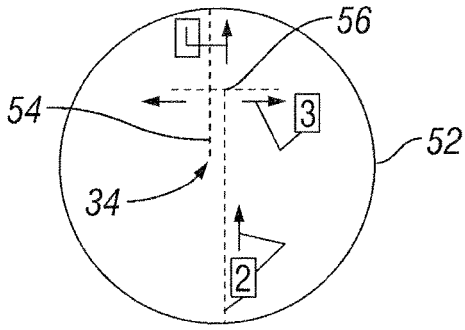
FIG. 3B is an illustration of the completion of the cut of FIG. 3A.

FIG. 3B is an exploded view of a cut finalization step 52 to create and complete a continuous cut 34. For example, in FIG. 3A it is desired create a window 38 and then to cleanly remove it from the tubular 12. This requires that the cut 34*b* be continuous. In FIG. 2, it is desired to remove the top portion of the tubular 12 from the wellbore 14; thus, it is necessary to complete a continuous cut 34*a*.

The continuous cut 34 is illustrated by the dashed line in FIG. 3B. The cut 34 is started at an initiation point 54 and proceeds in the direction of arrow 1. Desirably, the cut 34 is continued until it connects to the initiation point 54. However, due to miscalculations or movement of the tool 10, the cut 34 may not meet the initiation point 54 resulting in a non-continuous cut. To avoid an incomplete cut, the cut 34 is continued in the direction 2 to a termination point 56. The termination point 56 is located along the cut 34 past the initiation point 54. At the termination point 56, the cutter head 27 is moved substantially perpendicular, shown by arrow 3, to the previous direction of movement shown by arrows 1 and 2. In this manner, it is ensured that a continuous cut 34 is completed.

From the foregoing detailed description of specific embodiments of the invention, it should be apparent that a system and method for creating linear and non-linear cuts through tubulars in a wellbore that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A downhole cutting tool positionable in a tubular of a subsurface wellbore, the downhole cutting tool for creating a cut in the tubular and comprising:

a body securable within the tubular; and a cutting unit comprising:

a fluid pump for converting an initial fluid to a pressurized fluid, and a cutting head, the cutting head having a nozzle for directing the pressurized fluid to the tubular to create the cut in the tubular.

2. The downhole cutting tool of claim 1, wherein the cutting head is rotationally and axially moveable relative to the body.

3. The downhole cutting tool of claim 1, further comprising a linear actuator for axially moving the cutting head relative to the body, and a rotary actuator for rotationally moving the cutting head relative to the body.

4. The downhole cutting tool of claim 1, further comprising a control module functionally connected to the cutting unit to control the fluid pump.

5. The downhole cutting tool of claim 1, wherein said initial fluid comprises a wellbore fluid from the wellbore.

6. The downhole cutting tool of claim 5, wherein the cutting unit comprises a filter which filters the wellbore fluid to remove contaminants therefrom.

7. The downhole cutting tool of claim 1, wherein the pressurized fluid comprises an abrasive.

8. The downhole cutting tool of claim 1, wherein the cutting unit comprises a stored fluid in a fluid chamber thereof, and wherein said initial fluid comprises said stored fluid.

9. The downhole cutting tool of claim 1, wherein said initial fluid comprises a surface fluid from a surface of the wellbore.

10. The downhole cutting tool of claim 1, wherein said cut in the tubular is a circumferential cut.

11. The downhole cutting tool of claim 1, wherein said cut in the tubular is a window cut.

12. A method of cutting a tubular that is disposed in a subsurface wellbore comprising:

positioning a downhole cutting tool in the tubular;

actuating a fluid pump, which is disposed in the downhole cutting tool, to cause an initial fluid to be converted to a pressurized fluid; and directing the pressurized fluid to the tubular to form a cut in the tubular.

13. The method of claim 12 wherein said initial fluid comprises a wellbore fluid.

14. The method of claim 13, further comprising filtering the wellbore fluid to remove contaminants therefrom.

15. The method of claim 5, wherein said initial fluid comprises a stored fluid from a fluid chamber in the downhole cutting tool.

16. The method of claim 5, wherein said initial fluid comprises a surface fluid from a surface of the wellbore.

17. The method of claim 12, wherein said pressurized fluid comprises an abrasive.

18. The method of claim 12, wherein said cut in the tubular is a circumferential cut.

19. The method of claim 12, wherein said cut in the tubular is a window cut.

20. The method of claim 12, wherein said downhole cutting tool comprises a control module which controls said actuating.

21. A method of creating a continuous cut through a tubular that is disposed in a wellbore, the method comprising the step of:

providing a cutting tool including a positioning mechanism, an anchoring mechanism, a linear actuator, a rotary actuator, a cutting fluid pump and a cutting head having a nozzle for discharging a pressurized cutting fluid that penetrates and cuts the tubular;

positioning the tool in the tubular;

securing the tool in the tubular;

discharging the cutting fluid creating an initiation point of a cut through the tubular;

extending the cut from the initiation point along a first path via at least one of the actuators; and completing the cut.

22. The method of claim 21, wherein the step of completing the cut includes:

continuing the cut past the initiation point along the first path to a termination point; and traversing the cut across the first path.

* * * * *